United States Patent [19]

Tang

[11] 4,123,485

[45] Oct. 31, 1978

[54] STAGE CONSTRUCTION OF AN ELEVATED BOX GIRDER AND ROADWAY STRUCTURE

[75] Inventor: Man-Chung Tang, Queens, N.Y.

[73] Assignee: Dyckerhoff & Widmann Aktiengesellschaft, Munich, Germany

[21] Appl. No.: 789,223

[22] Filed: Apr. 20, 1977

[51] Int. Cl.[2] ..... E04B 1/16; E01D 19/12

[52] U.S. Cl. ..... 264/33; 14/73; 52/174; 249/20; 264/34; 264/228; 425/63

[58] Field of Search ..... 264/33, 34, 228; 52/174; 14/73; 249/20; 425/63

[56] References Cited

U.S. PATENT DOCUMENTS

| | | | |
|---|---|---|---|
| 3,084,481 | 4/1963 | Silberkuhl | 52/174 X |
| 3,906,687 | 9/1975 | Schupack | 52/174 X |
| 3,985,480 | 4/1975 | Finsterwalder | 249/20 X |
| 3,989,218 | 11/1976 | Muller | 264/33 X |

*Primary Examiner*—Thomas P. Pavelko

*Attorney, Agent, or Firm*—Toren, McGeady and Stanger

[57] ABSTRACT

An elongated elevated box girder and roadway structure is constructed in a number of individual elongated sections with the support structure and formwork being reused, in turn, for each section. Each section is constructed in a number of stages. Initially, a support structure is built up from grade or is mounted on permanent upright members of the structure being formed, such as piers or abutments. Formwork for the bottom slab and the upright outside webs of the box girders are placed upon the support structure. Concrete is poured into the formwork for the bottom slab and webs and, after being allowed to set for a given period, and posttensioned, if necessary, the formwork is stripped and the support structure is removed. The support structure and formwork are then moved and set up for the next section to be constructed. The roadway slab includes the top slab of the box girder and cantilever sections extending laterally outwardly from each side of the top slab. The roadway slab is supported from the previously poured bottom slab and webs It can be poured in one or two steps, pouring the entire roadway at one time or first pouring the top slab and then, after supporting the formwork of the cantilever sections from the top slab, pouring the cantilever sections. After the concrete for the roadway sets for a given period, its formwork is stripped, moved and set up for pouring the next section.

8 Claims, 12 Drawing Figures

STAGE CONSTRUCTION OF AN ELEVATED BOX GIRDER AND ROADWAY STRUCTURE

BACKGROUND OF THE INVENTION

The present invention is directed to the construction of an elevated concrete roadway structure in a number of sections, and, more particularly, it is directed to the construction of a combination box girder and roadway structure where each section is built in a number of stages.

The construction of elevated roadway structures is well known. Such structures may be a simple span between two abutments or it may consist of a structure supported on a number of piers or abutments for instance, where a roadway crosses over a valley. It is not unusual for such an elevated roadway structure to extend for half a mile or more. In the development of highway systems throughout the world, such as the interstate system in the United States, at the outset elevated roadway structures consisted of structural steel girders and beams spanning concrete abutments or piers with a concrete roadway slab supported on the structural steel. More recently, to limit the use of structural steel and to achieve the savings in costs attainable by using all concrete structures, it has been known to span the vertical supports, that is, piers or abutments, with a concrete box girder and roadway structure. Elevated box girder and roadway structures require either a falsework or a truss support for the concrete formwork. While a falsework support extends upwardly from grade to the elevated roadway, a truss support made of structural steel is supported on the upper parts of the vertical supports. In the past the practice has been to construct the entire box girder and roadway slab so that it is formed in a single monolithic pour. Such a procedure requires a very substantial underpinning in the form of falsework or a truss support. While the falsework or truss support is reused for each span or section of the elevated structure the costs of moving and setting up the supporting structure has been considerable.

Therefore, it is the primary object of the present invention to simplify the support structure required to underpin such elevated roadway structures and to effect a considerable reduction in costs both in the materials used and in the time required to set up the support structure.

Another object of the invention is to provide a more efficient procedure for constructing an elevated box girder and roadway structure where work can be carried out on adjacent spans or sections at the same time.

SUMMARY OF THE INVENTION

In constructing an elevated roadway structure, initially the vertically extending piers or abutments are built and then the elevated roadway structure is extended over the vertical supports. In accordance with the present invention, the roadway structure can be supported from falsework built up from grade or it can be supported from truss members or similar structural members supported, in turn, from the vertical supports. While the use of falsework for supporting the roadway structure might be economical if the height of the roadway above grade is not great, usually the height of the elevated roadway is such that it is more economical to use truss supports bearing on the upper ends of the vertical piers.

With the support structure in place, whether falsework or a structural steel truss support is used, the forms for the bottom slab and the outside upright webs of the box girder are placed on the support. The length of each section of the elevated roadway structure to be poured is approximately the same as the span between piers. The U-shaped portion of the box girder formed by the bottom slab and the outside upright webs is poured and allowed to set. After the poured portion has set for a sufficient period and has been posttensioned, if necessary, the forms are stripped and the support structure is ready to be moved to the next section to be poured. Preferably, a pair of structural steel trusses form the support structure. Where a single pier, such as a cylindrically or rectangularly shaped concrete column forms the vertical support, the trusses can be placed on the opposite sides of the pier for ease in movement from one section to the next. Generally speaking, more time is involved in moving a falsework support structure for each section than would be needed for a structural steel truss support structure. After the U-shaped poured section of the box girder has set sufficiently, it can be used to support the formwork either for the top slab of the box girder or for the combination of the top slab and the cantilever slabs of the roadway which extend laterally outwardly from the opposite sides of the box girder. Preferably, each section of roadway is built in two pours, first the top slab which spans the previously poured portion of the box girder and then the cantilever slabs. The formwork for the top slab is supported within the partly formed box girder and the top slab is poured. After sufficient time has passed for the top slab to be set, its forms are stripped and the forms for the cantilever slabs are hung from the top slab. The cantilever slab sections of the roadway are then poured and after the concrete is allowed to set for a given period of time, the forms are stripped.

After each stage in the pouring of an individual section is completed, the support structure and formwork is moved to the next section and set in place. With this procedure, a continuous construction operation is provided, affording a time saving and economical construction method.

In the past, the usual procedure in constructing such a box girder and roadway has been to form one section of the box girder and the roadway all at one time and then to pour the entire section. In accordance with the present invention, in the initial pour of the bottom slab and the outside upright webs of the box girder, only about one-third of the weight of the total structure is poured. In other words, the support structure need be designed to support only a third of the total structure instead of its total weight. Therefore, the weight carried by the support structure is very significantly reduced and a considerable savings is effected in both the materials required for the support structure in the time needed to erect and move it. Once the bottom slab and the outer sides of the box girder have been formed, the remaining formwork can be supported off the already poured box girder portion and the support structure required for the first stage pour, can be moved and set in place to pour the next section.

The box girder and roadway structure can be constructed of conventional reinforced concrete or prestressed concrete. Known procedures can be used for prestressing the concrete.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
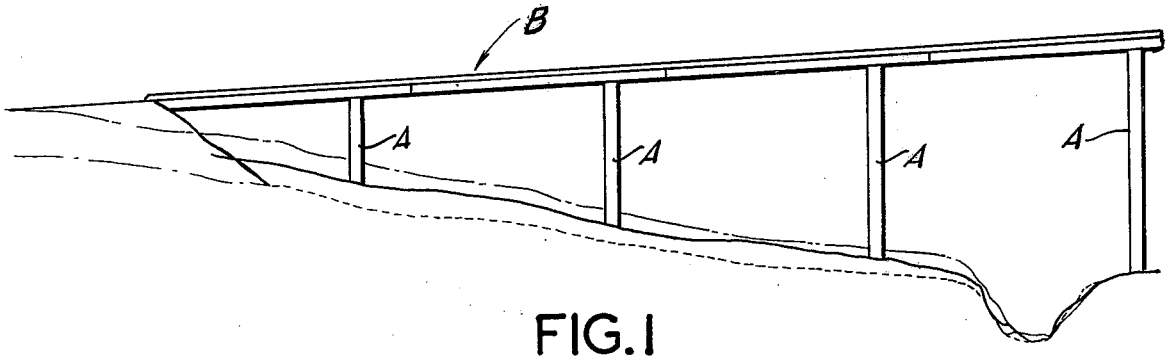
FIG. 1 is a schematic side elevational view of an elevated box girder and roadway structure embodying the present invention.

In FIG. 1 a part of an elongated elevated box girder and roadway structure is illustrated crossing a valley. The structure consists of vertically extending piers or abutments A with a box girder and roadway structure B supported on the upper ends of the piers. As can be seen, the height above grade varies for the individual spans forming the elevated structure. First, the piers or abutments are built and then the box girder and roadway structure B is constructed across the tops of the piers A. The horizontal cross section of the piers can have various shapes, for instance, rectangular, square or circular. The shape of the pier does not form a part of the invention.

The height of the roadway structure above grade normally determines whether a falsework support or a truss support is used to sustain the forms for the box girder and the roadway structure. If the height is relatively shallow it might be economical to use falsework supported directly from grade, however, where the height above grade is appreciable, for instance, over 150 feet, it may be more economical to use the truss support.

Figure 8:
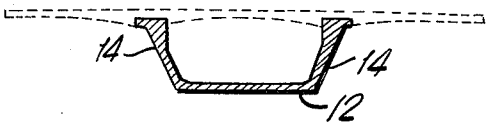
FIGS. 8, 9 and 10 are transverse cross sectional views illustrating the three stages in the construction of the box girder and roadway slab.
Figure 9:
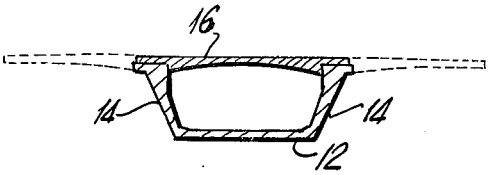
Figure 10:
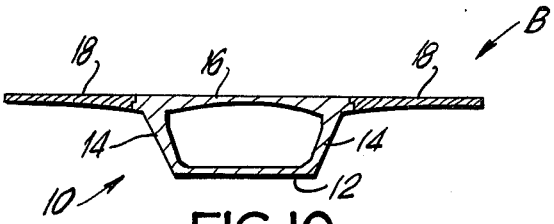

In accordance with the present invention, the elevated box girder and roadway structure B for each section is constructed in three stages, note FIGS. 8, 9 and 10. The completed box girder and roadway structure B consists of a box girder 10 having a bottom slab 12, upright outside webs or sides 14 and a top slab 16. The top slab forms the center portion of the roadway. The remainder of the roadway is formed by a pair of cantilever slabs 18 each extending laterally outwardly from opposite sides of the top slab 16. FIG. 10 shows the completed box girder and roadway structure.

The box girder and roadway structure B is poured in three stages, stage I is shown in FIG. 8, stage II in FIG. 9 and stage III in FIG. 10. In stage I, a U-shaped structure is formed consisting of the bottom slab 12 and the sides 14 of the box girder. As illustrated, the box girder has no interior webs, only the outside webs or sides, however, depending on structural considerations it would be possible to include interior webs which could be poured in either stage I or stage II.

In stage II, the top slab 16 is poured spanning the space between the outside webs 14.

In stage III the cantilever slabs 18 are poured along and outwardly from either side of the box girder. While it is possible to combine stages II and III in the concrete pouring sequence, it is preferable to pour the top slab in one stage and the cantilever slabs in a following stage.

Figure 2:
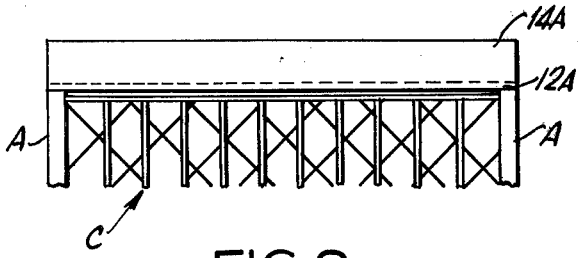
FIG. 2 is a schematic side elevational view of a falsework support for a portion of the box girder.
Figure 3:
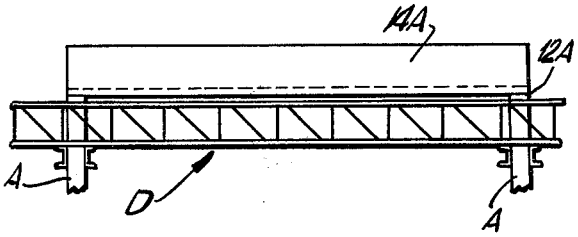
FIG. 3 is a schematic side elevational view of a truss support for a portion of the box girder.
Figure 4:
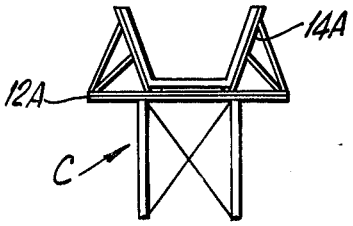
FIG. 4 is a schematic transverse view of the formwork for the portion of the box girder mounted on the falsework support of FIG. 2.

In FIGS. 2 and 3 the piers A have been poured to the required height and the first stage in the construction of the elevated box girder and roadway structure is ready to commence. The falsework C is constructed from grade up to the required height for supporting the formwork for the bottom slab 12 and the outside webs 14. While it is possible to use falsework, under general conditions considering the height at which such roadways are built, it is preferable to use the truss support shown in FIG. 3. The truss support D is formed of two structural steel trusses and is of a sufficient length to extend beyond, in each direction, the span between a pair of adjacent piers A. The truss supports D are placed on bearing members attached to the piers so that the upper side of the truss is at the required height to support the formwork for the bottom slab 12 and the outside webs 14. The formwork 12A, 14A for the bottom slab and outside webs, respectively, is conventional and is adapted to the particular shape and structural considerations involved in the box girder. With the formwork in position, the reinforcing steel or prestressing members can be placed in the forms and then the concrete is poured completing stage I as shown in FIG. 8.

Figure 5:
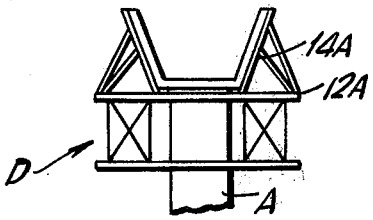
FIG. 5 is a transverse view similar to FIG. 4 with the formwork for the portion of the box girder supported on the truss support illustrated in FIG. 3.

After the concrete of stage I is permitted to set for a predetermined period based on various factors, and in particular the weather, usually for a period of 3 to 7 days, the formwork is stripped and held for reuse. If falsework C has been used, it is taken apart, moved to the next section to be poured and reassembled. It is more simple, however, if a truss support D is used which, as is illustrated in FIG. 5, consists of two separate trusses, one on each side of the pier A. With the formwork for the bottom slab and the outside webs stripped, the truss support is ready to be moved. The trusses can be slid on the bearing support fixed to the piers from one span to the next. For instance, as viewed in FIG. 1, with stage I pour completed for the first span between the first left-hand set of piers, the truss support is moved to the right until it spans the space between the second and third piers counting from the left. With the truss support in place the forms for the bottom slab and the side webs can be set and the stage I pour of the next section can be made.

Figure 6:
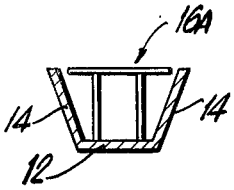
FIG. 6 is a transverse sectional view of the portion of the box girder, supporting framework for the top slab of the girder.

As indicated in FIG. 6, the formwork 16A for the stage II pour is supported within the U-shaped portion of the box girder and the reinforcing steel or prestressing member are placed. The formwork for stage II is also of a conventional type and, depending on the size of the box girder, can be stripped after a given period of time has elapsed following the pour, or the forms may be left in place. It can be appreciated that, considering the limited weight of the top slab 16 of the box girder, the formwork required to support it, is relatively simple and the previously poured U-shaped portion of the box girder is adequate to support the top slab.

Figure 7:
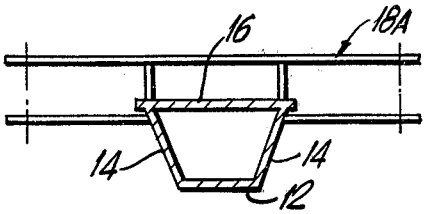
FIG. 7 is a transverse cross sectional view of the formwork for the cantilever sections of the roadway slab, supported from the previously poured box girder.

Following the stage II pour, the formwork of the top slab can be stripped and moved for reuse in forming the next section of top slab. As shown in FIG. 7, the formwork 18A for the cantilever slab is supported off the box girder structure, primarily off the top slab. With the cantilever slab formwork 18A set in position and the reinforcing steel or prestressing member installed, the cantilever slabs 18 are poured, completing stage III and completing the box girder and roadway structure as indicated in FIG. 10. When the cantilever slabs have set for a sufficient period of time to be self-supporting, the cantilever slab formwork 18A is stripped and moved for use in the next section to be poured.

This procedure of setting the falsework or truss support, placing the formwork and reinforcement for the various stages and pouring the concrete in each of the three stages can be repeated until the entire elevated structure is completed.

The truss support, as described herein, can also be provided by similar structural members such as a steel plate girder or other type of girders made of steel or of other materials.

Figure 11:
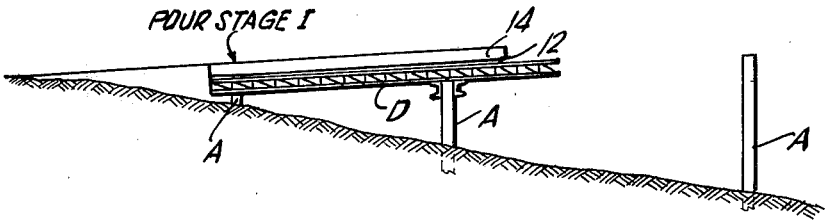
FIG. 11 is a schematic side elevational view illustrating the position of the support truss for pouring the first section of the box girder.
Figure 12:
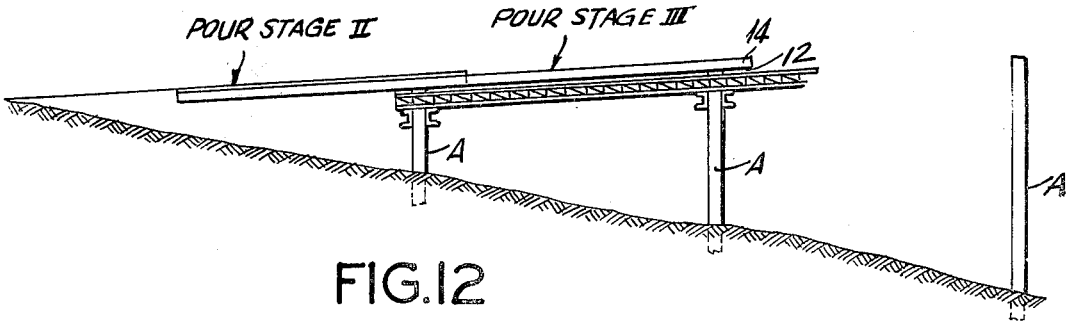
FIG. 12 is a view similar to FIG. 11 showing the support truss moved for constructing a second section of the box girder.

In FIGS. 1, 11 and 12 it can be noted that the construction joint between adjacent sections of the elevated structure is located approximately at one of the quarter points between adjacent piers A. The quarter points are the positions of least stress. The joint between adjoining pour stages are conventional and do not form any part of the present invention.

A typical box girder and elevated structure would have the following dimensions:

| | |
|---|---|
| Width of box girder across the bottom slab | 16 feet |
| Width of box girder across the top slab | 22 feet |
| Height of the box girder | 9 feet |
| Width of the cantilever slabs | 15 feet |
| Overall width of the roadway structure between curbs | 52 feet |

With uninterrupted working conditions, it would take from five to ten working days to complete the three stages of the pouring sequence, that is, to complete one section of the elevated structure.

It can be appreciated that the procedure embodied in the present invention significantly reduces the materials required for supporting stage I of the concrete pouring sequence and following stage I the poured portion of the box girder provides the necessary support affording a very significant reduction in materials used and also in the time required to complete the preparations for a stage II or stage III pour.

While specific embodiments of the invention have been shown and described in detail to illustrate the application of the inventive principles, it will be understood that the invention may be embodied otherwise without departing from such principles.

What is claimed is:

1. A method of constructing an elongated roadway structure including a box girder and roadway slab where the box girder includes a bottom slab, upright webs including two laterally spaced outside webs extending upwardly from the bottom slab and defining the outside surfaces of the box girder and a top slab extending transversely across the upper ends of the outside webs and forming a part of the roadway slab, and the roadway slab including two cantilever sections each extending laterally outwardly from an opposite side of the top slab transversely of the elongated direction, comprising the steps of setting up a support structure for a portion of the elongated dimension of the roadway structure, supporting forms for the bottom slab and the two outside webs of the box girder on the support structure so that the opposite ends of the forms for the bottom slab and the two outside webs spaced apart in the elongated direction of the roadway structure rest on the support structure and providing bearing support for the support structure at least adjacent the opposite ends of the support structure spaced apart in the elongated direction of the roadway structure, pouring concrete into the forms for the bottom slab and the outside webs for constructing a first section of the bottom slab and the outside webs and allowing the concrete to set for a predetermined period, removing the support structure and the forms for the bottom slab and the outside webs from the first section after the completion of the predetermined period, supporting forms for the roadway slab from the bottom slab and the outside webs of the first section and pouring concrete into the forms for the roadway slab of the first section, moving the support structure to the next section of the box girder to be constructed, moving the supporting forms for the bottom slab and the outside webs and placing them on the support structure for the next section of the box girder to be constructed, pouring concrete into the form for the bottom slab and the outside webs of the next section, moving the forms for the roadway slab to the next poured section of the bottom slab and outside web and supporting the forms from the poured bottom slab and outside webs, pouring the roadway slab of the next poured section and repeating the foregoing steps of constructing a section of the elongated dimension of the elevated structure until the elevated structure has been completed.

2. A method, as set forth in claim 1, wherein in the step of supporting forms for the roadway slab, first placing the form for the top slab of the box girder on the poured section of the bottom slab and the two outside webs, pouring the top slab of the box girder, supporting the forms for the cantilever sections of the roadway from the poured top slab of the box girder and pouring the cantilever sections.

3. A method, as set forth in claim 2, including removing the form for the top slab of the box girder section before placing the forms for the cantilever sections.

4. A method, as set forth in claim 1, including the step of constructing upwardly extending piers as permanent support members for the box girder and roadway, and providing bearing support for the support structure by supporting the support structure for the bottom slab and the outside webs on the upper portions of adjacent piers.

5. A method, as set forth in claim 4, including the step of moving the support structure for each of the sections of the elevated roadway structure between adjacent pairs of piers.

6. A method, as set forth in claim 1, wherein the step of setting up a support structure comprises constructing the support structure as a falsework structure supported from grade over which the elevated roadway structure passes.

7. A method, as set forth in claim 1, including the steps of placing reinforcing steel in the framework for each of the separate pours required for constructing the box girder and roadway structure.

8. A method, as set forth in claim 1, including the steps of placing prestressing steel in each of the separate pours required for constructing the box girder and roadway structure, and after pouring the concrete, posttensioning the prestressing members.

* * * * *